United States Patent [19]

Keehne

[11] Patent Number: 4,671,598

[45] Date of Patent: Jun. 9, 1987

[54] BACKSHELL CONNECTOR FOR MULTI-CONDUCTOR SHIELDED CABLES

[75] Inventor: Julian L. Keehne, Titusville, Fla.

[73] Assignee: Schiller Industries Inc., Orlando, Fla.

[21] Appl. No.: 779,825

[22] Filed: Sep. 25, 1985

[51] Int. Cl.[4] ..... H01R 13/46; H01R 13/648

[52] U.S. Cl. ..... 439/610

[58] Field of Search ..... 339/14 R, 143 R, 136, 339/138, 141, 89 M

[56] References Cited

U.S. PATENT DOCUMENTS

| | | | |
|---|---|---|---|
| 2,286,952 | 6/1942 | Cannon et al. | 339/89 M X |
| 2,737,543 | 3/1956 | Irwin et al. | 339/89 M |
| 3,659,251 | 4/1972 | Fish | 339/143 R |

*Primary Examiner*—Eugene F. Desmond

*Attorney, Agent, or Firm*—Mandeville and Schweitzer

[57] ABSTRACT

A terminal connector assembly is disclosed, for joining a connector plug or the like to a multi-conductor shield and cable. The assembly comprises first and second backshell housing members. The first or forward housing member has a closed tubular configuration at its forward end, joinable with the connector plug. The remote portion of the housing is of partial tubular configuration, preferably semi-cylindrical, and has a threaded portion at its remote and extremity. A second backshell housing is complementary to the partial tubular configuration of the first housing member and interfits closely with it, having a complementary threaded portion at its end extremity. A tubular sleeve is insertable laterally into the open side of the backshell member. The sleeve houses clamping rings securing the shielding braid of the cable. The construction allows the braid to be engaged and clamped prior to lateral installation of the sleeve within the backshell housing. Preparation of the general assembly is greatly expedited and improved. Improved EMI/RFI radiation shielding is provided by locating the sleeve to bridge the area adjacet the threaded portion of the housing.

1 Claim, 9 Drawing Figures

BACKSHELL CONNECTOR FOR MULTI-CONDUCTOR SHIELDED CABLES

BACKGROUND AND SUMMARY OF INVENTION

Industrial and commercial electronic equipment, computers being a notable example, typically require multi-conductor cable interconnections between component elements. Because of high frequency operations, there is considerable potential for electro-magnetic interference (EMI) and radio frequency interference (RFI) emissions from the multi-conductor cables. Accordingly, such cables typically are encased within a tubular braided wire shield.

For detachable connection of the cables to the individual components, multi-pin connector assemblies are typically provided. Such connector assemblies typically provide means for grounding of the shield, mechanical strain relief and, of course, joining of the individual cable conductors to the connector pins. Additionally, in a quality installation, the connector assembly will include features for maintaining the integrity of the EMI/RFI shield. An advantageous form of such connector assembly includes the connector proper, containing the connector means and, typically, mechanical arrangements for joining the connector to a mating connector of the opposite sex. In conjunction with the connector proper, there is provided a backshell assembly which is, in effect, a housing attachable to the connector, for containment of the individual cable conductors in the transitional region from the cable proper to the individual cable pin connections.

Conventional backshell assemblies of the general type contemplated by the present invention typically include a tubular split or partially backshell housing, which may be in a straight line or elbow configuration. The front end of the backshell housing is threadedly connectable to the terminating connector. The remote end typically contains a recess for the reception of shield clamping rings which secure the terminal end of the shielding conductor. A cable clamp element is threadedly connectable to the remote end of the backshell housing and serves to force the shield clamping rings into the backshell recess thus tightly clamping the shielding conductor. The cable clamp itself typically contains clamping jaws engageable with the exterior of the multi-conductor cable. The cable clamp and the compressed shield clamping rings together provide for mechanical strain relief.

The above described, multi part connector-backshell assembly is widely used because it provides access to the backs of the connector pins to enable joining of the cable conductors to the terminal connector. The conventional design suffers from a significant disadvantage, however, in that, in a backshell of partially split construction, the length of exposed conductors, beyond the end of the shielding conductor, must be such that, after joining of the conductors to the terminal connector and mechanical securement thereof to the front end of the backshell housing, the free end of the shielding conductor must be accessible for positioning within the shield clamping rings. Once the shield is properly positioned and clamped between the rings, the rings must then be forced axially into the remote end of the backshell housing. This necessitates physical displacement of the multiple conductors within the contained space of the backshell housing. Often, this requires considerable force on the part of the assembly person. In a cable having numerous conductors, the operation is both difficult and time consuming, and not infrequently causes damage to the conductors and/or their connections, particularly the connection of the shielding conductor.

In accordance with the present invention, a novel and improved backshell construction is provided which, while being highly simplified in form, is significantly more effective than previous constructions for the same purpose. The new construction completely eliminates the need to effect forceable mechanical displacement of conductors within the backshell housing during the final assembly. Assembly and disassembly of the connector-backshell structure is simplified and expedited, and damage to the conductors during the closing procedure is greatly reduced.

Importantly, the backshell structure of the present invention provides, in addition to the above mentioned advantages, significantly superior protection against EMI/RFI leakage in the connector-backshell region.

For a better understanding of the above and other features and advantages of the invention, reference should be made to the following detailed description of preferred embodiments of the invention and to the accompanying drawing.

DESCRIPTION OF PREFERRED EMBODIMENTS OF THE INVENTION

Figure 1:
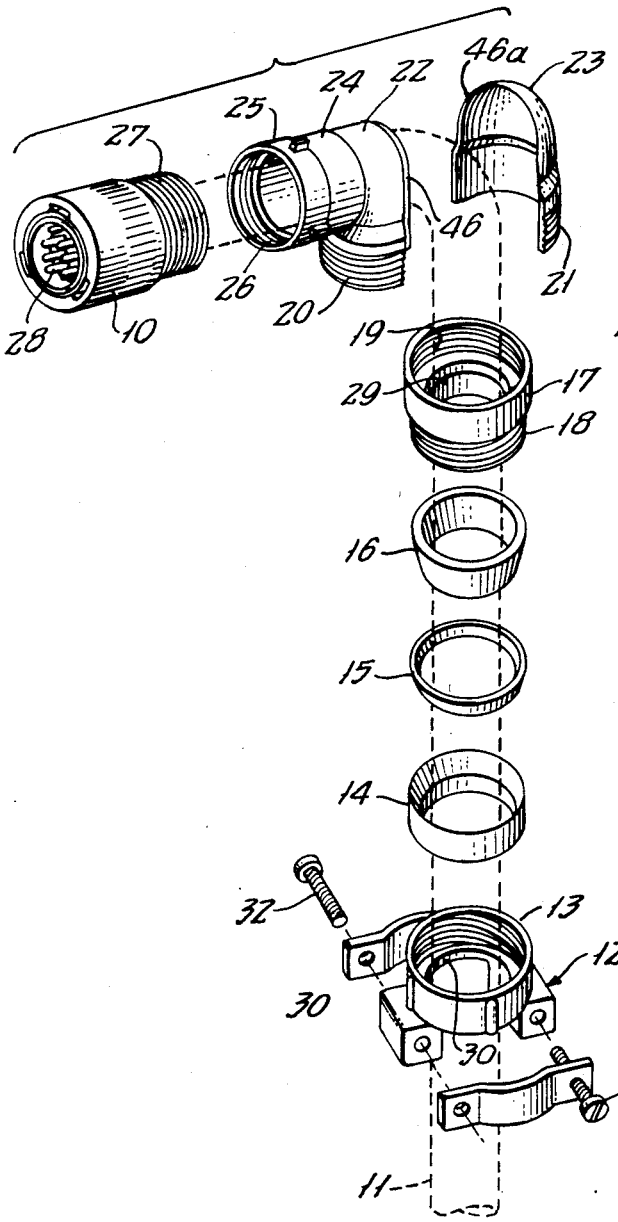
FIG. 1. (PRIOR ART)
FIG. 1 is an exploded, perspective illustration of a conventional form of partially split backshell assembly provided in order to simplify comparison with the improved construction of the invention.

Referring now to the drawing, and initially to FIG. 1 thereof representing a backshell and connector construction of conventional design, the reference numeral 10 designates generally a conventional multi-pin terminal connector, to which the individual conductors of a multi-conductor cable 11 are to be attached. Preliminary to the assembly, the series of parts are slipped over the free end of the cable 11 in proper order for the eventual assembly. These are, from the remote end forward, a strain relief clamp 12 with attached, rotable threaded coupling 13, a plurality of cable shield clamping rings 14–16, an adaptor collar 17 having external threads 18 for engagement with the internally threaded strain relief coupler 13, and internal threads 19 for engagement with threads 20, 21 of the assembled backshell housing, comprising housing parts 22, 23.

The backshell housing 22, 23 is referred to herein as of "partially split" construction, in that the forward portion of the housing element 22 is tubular in form, and constitutes the last element slipped over the end of the cable 11 in preparation for the attachment to terminal connector 10. The tubular front section 24 of the housing mounts a rotatable collar 25, which is internally threaded at 26 for engagement with external threads 27 on the terminal connector itself.

In preparation for the making of a terminal connection, using the conventional backshell assembly, all of the described parts are slipped over the free end of the cable 11 which, either previously or thereafter, is stripped back a predetermined distance to expose the individual conductors. These individual conductors are connected to the terminal pins 28 of the connector 10 in a conventional manner. The backshell assembly is then closed in the manner described below.

After connection of the individual conductors, the first section 22 of the backshell housing is secured to the connector 10 by means of the threaded collar 25. The cable is, at this time, bent through a 90° angle to accommodate assembly of the backshell cover 23 to the front section 22, allowing the respective semi-cylindrical threaded sections 20, 21 to be aligned in mating relation. The adaptor member 17 is now applied tightly over the threads 20, 21, securing the backshell housing parts 22, 23 in assembled relation.

The bundled conductors of the cable 11 are encased in a braided, metallic shield (not specifically illustrated in FIG. 1, but of well known construction), and the initial stripping back of the cable is done in such manner that, after partial assembly of the backshell housing to the point described, the leading edge of the braided shield is exposed slightly below the lower, externally threaded end of the adaptor 17. The shield is at this time peeled back over the upper edge of the ring 16 and laid along its outer walls. The rings 15 and 14 are then slipped over the ring 16, to provide a mechanical and electrical connection with the braided shield.

At this point in the assembly, it is necessary for the operator to physically force the assembled shield connection up into an interior recess 29 in the adaptor 17. This, of course, requires physical displacement of the individual conductors within the now-closed backshell housing. Historically, this is a difficult and time-consuming stage of the connector assembly procedure. Not infrequently, during this procedure, the connection to the braided shield is damaged and/or disfigured.

After the new shield clamp has been forced adequately into the adaptor recess 29, the strain relief coupler 13 is engaged with the threads 18 and tightened thereon. A shoulder 30 in the lower portion of the threaded coupler 13 engages the bottom of the shield clamping ring 14, forcing it tightly up into the recess 29 and, by reason of the tapered configuration of surfaces of the rings 14, 16, tightening the grip on the braided shield.

As a final operation, the cable clamp 12 is tightened, by means of screws 31, 32, onto the cable for providing mechanical strain relief.

The new backshell structure of the invention, while seemingly quite similar to the prior art construction, represents a major improvement thereover, in that the clamping and securement of the braided shield may be effected prior to closing of the backshell housing. There are two major benefits from this ability: First, the exposed length of conductors does not have to be of excessive length, requiring physical displacement of the conductors within the housing, as in the prior art construction. Second, a greater length of the conductor is exposed in the region of the free end of the braided shield, prior to closing of the housing, so that the manipulation of this shield for engagement by the clamping rings is facilitated.

Figure 2:
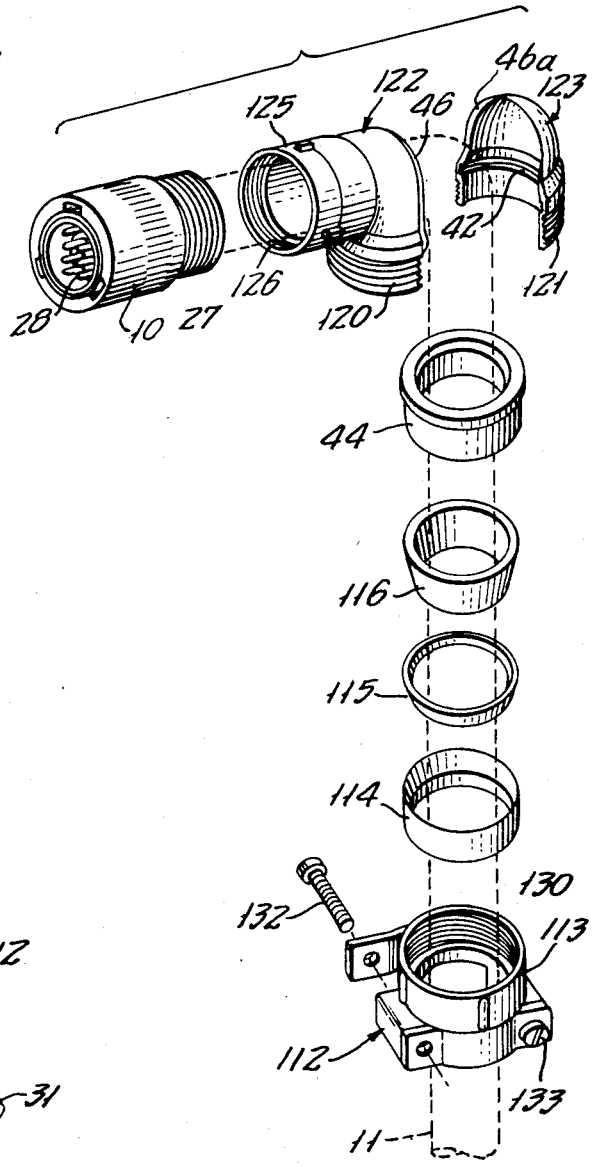
FIG. 2 is an exploded, perspective illustration, similar to that of FIG. 1, but illustrating the new backshell construction in a 90° elbow configuration.

Referring now to FIG. 2, the terminal assembly includes the terminal connector fitting 10 provided with external threads 27 and connector pins 28, substantially as in the prior art. A two-part backshell housing, comprising a front part 122 and a back part 123, is provided. Each of the housing parts is provided with a semi-cylindrical threaded portion 120, 121, and the front housing part incorporates a rotatable coupling collar 125 provided with internal threads 126 for mating with the connector threads 27.

Externally, the backshell housing 122, 123 appears substantially similar to the prior art housing. Internally, however, the structure differs significantly. Thus, a short distance above the upper end 40 of the threaded sections 120, 121 (see FIG. 8) the housing parts are provided internally with an annular recess 41, 42 for the reception of the flanged upper end 43 of an adaptor sleeve 44. The sleeve 44 has a cylindrical skirt 45 which fits closely within the assembled backshell housing parts 122, 123, internally of the threaded sections thereof, preferably terminating at or slightly above (inside) the lower end of the threaded sections.

As evident in the drawings, one of the backshell housing parts (part No. 122 in the illustrated instance), is provided about its edge with a peripheral flange 46 which extends continuously about its open edge, from one side to the other, starting just above the threaded area. This flange is received within a complementary recess **46*a* in the other housing part. As a practical matter, it is difficult to extend the flange 46 and recess 46*a* along the threaded areas of the backshell housing parts without making those sections of the housing parts unduly heavy. Accordingly, in the typical construction, both of the prior art and of the new design, the flange 46 terminates at each side at 47, just above the commencement of the threads. And pursuant to one aspect of the invention, the flanged sleeve 44 extends from a point well above the terminal end 47 of the flange 46** to a point well beyond the commencement of the threaded section. The sleeve thus completely bridges the area in the vicinity of the initiation of threads on the backshell housing parts.

Figure 8:
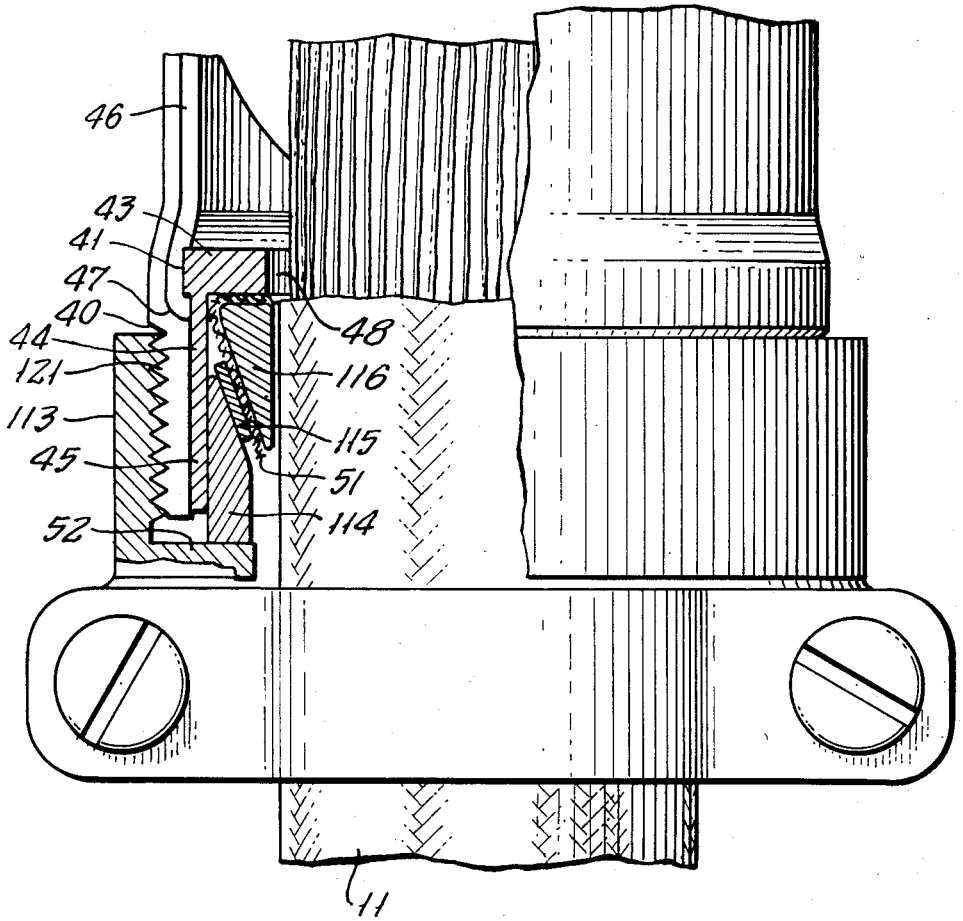
FIG. 8 is an enlarged, fragmentary elevational view, partially in section, illustrating details of the manner in which the cable shield is secured in a radiation-free manner within the new backshell device.

As illustrated particularly in FIG. 8, the flanged sleeve 44 is provided at its upper end with a central opening 48 of a diameter just slightly greater than the external diameter of the cable 11, allowing the sleeve to be slipped over the cable, along with the other parts, as part of the pre-assembly procedure.

Figure 3:
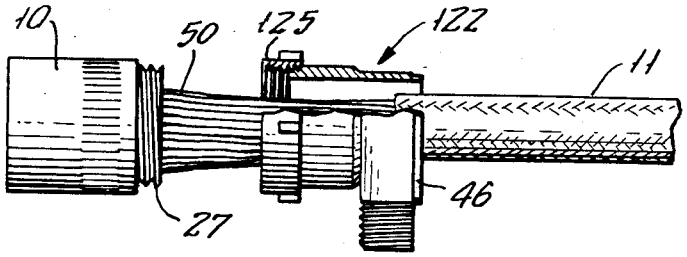
FIGS. 3, 4 and 5 are sequential illustrations showing several of the steps involved in the installation of a terminal connection utilizing the backshell assembly of the invention.
Figure 4:
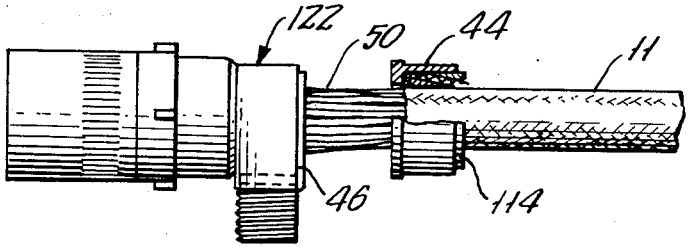
Figure 5:
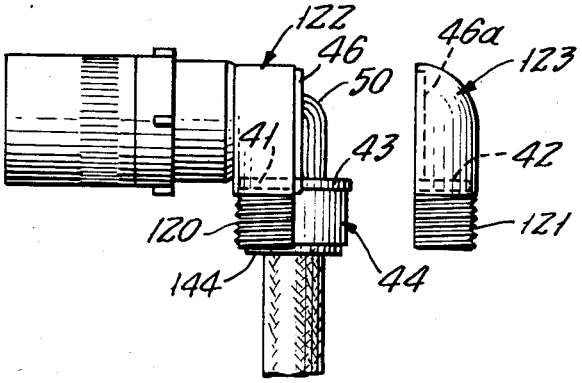
Figure 6:
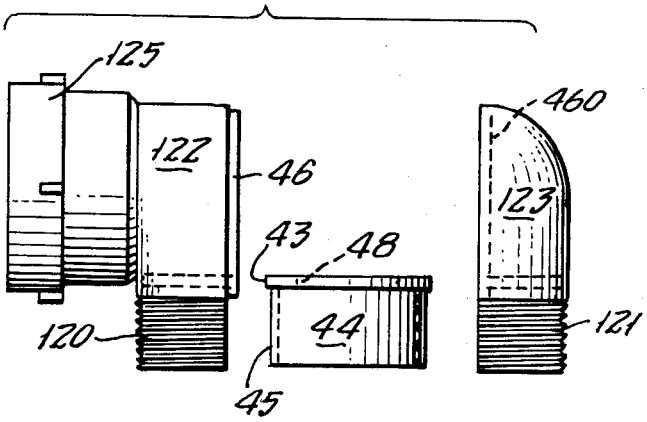
FIG. 6 is an exploded, elevational view of portions of the new backshell device, prior to assembly.
Figure 7:
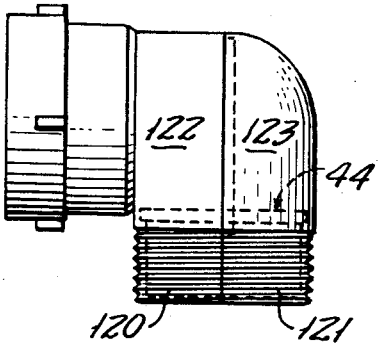
FIG. 7 is an elevational view, similar to FIG. 6, showing the device after assembly of the principal parts.

The assembly of a connector and backshell structure according to the invention is illustrated in part in FIGS. 3–5. At the outset, the various parts will have been applied over the free end of the cable. These include the cable clamp 112, with its threaded collar 113, the three shield clamping rings 114–116, the flanged sleeve 144 and the front backshell housing part 122. The individual conductors 50 are connected to the terminal pins of the connector plug 10 in a normal fashion, as reflected in FIG. 3. Thereafter, the main backshell housing part 122 is advanced to the terminal connector 10, and the coupling ring 125 is threadedly engaged with the end of the connector. The partial assembly, at this stage, is illustrated in FIG. 4.

As reflected in FIG. 4, although the backshell housing is of a right angle elbow design, the cable 11 will at this juncture extend straight out from the connector 10, providing easy access to the end of the braided shielding layer 51 (see FIG. 8).

To secure the shield conductor, the flanged sleeve 44 is advanced to a position forward of the shield end, more or less in contact with the backshell housing part 122. The end of the shielding layer is engaged behind the sleeve 44 and wrapped outward around the first clamping ring 116, which is of wedge-shaped cross section, as reflected in FIG. 8. At this stage of the assembly, the wedge-shaped clamping ring 116 is positioned a predetermined distance back from the front housing part 122. After the braid is wrapped outwardly over the outer surface of the clamping ring 116, the sleeve 44 may be retracted to a position surrounding the clamping ring, substantially as shown in FIG. 4, and the clamping rings 114, 115 may be advanced into position. The relationship of the parts is such that the lowermost clamping ring 114 projects axially slightly beyond the open or "lower" end of the flanged sleeve 44, as reflected in FIGS. 4 and 8.

At this stage, the portion of the cable extending from the front backshell housing 122 is bent through a 90° turn and brought into a position, as shown in FIG. 5, in which the flanged sleeve 44 is seated within the front backshell housing member 122, with the flange 43 thereof seated snugly within the internal recess 41 of the backshell housing. To particular advantage, this manipulative operation can be carried out swiftly and with little difficulty because of the relatively accurate prepositioning of the flange sleeve 44 on the extended part of the cable 11, and because of the fact that the exposed individual conductors 50 are readily accessible in the still-opened backshell housing assembly, so they may be easily manipulated, if necessary, to accommodate full seating of the sleeve 44 within the housing part 122.

Once the flanged sleeve 44 is seated within the front backshell housing part 122, the outer backshell housing part 123 is snapped into place to close the backshell housing and the flanged sleeve 44. The threaded collar 113 of the cable clamp is now advanced over the assembled threaded portions 120, 121 of the backshell housing parts and brought into tight relation. A flange 52, at the bottom of the threaded collar 113, engages the lower end of the clamping ring 114, causing the shielding braid 51 to be tightly gripped by the rings 114–116. The backshell housing parts 122, 123 are locked in their assembled relation by the threaded collar 113, as will be understood.

Figure 9:
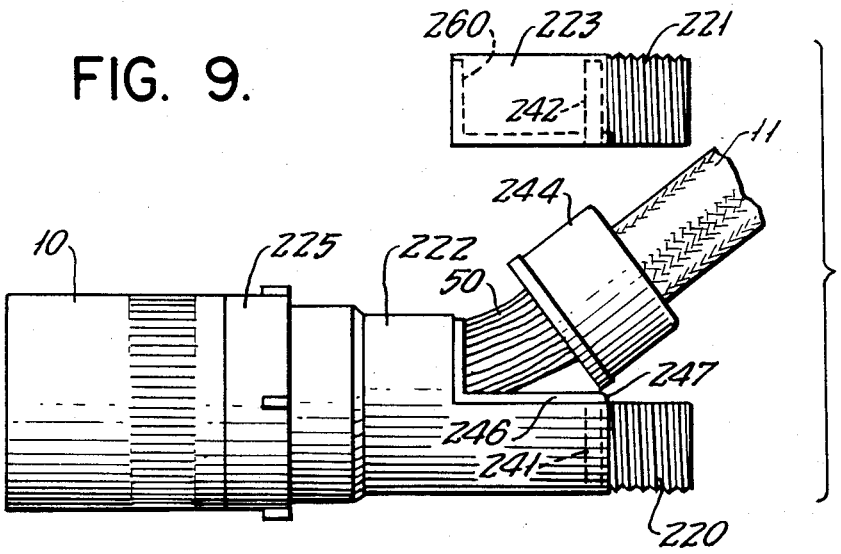
FIG. 9 is an exploded elevational view illustrating the manner of assembly of the new backshell device in a straight line configuration.

In the modified form of the invention, shown in FIG. 9, the backshell housing is of straight line configuration, consisting of a front housing part 222 and a back housing part 223. The front housing part 222 has a front portion of full cylinder cross section, mounting a rotatable, internally threaded coupling sleeve 225. The front housing portion has a peripheral flange 246 which extends from one side of the threaded section 220 to the other. Internally, the housing part is provided with a semi-cylindrical recess 241, which is located forward of the end of the threaded section 222 and also at least slightly forward of the end extremity 247 of the flange 246. The outer housing part 223 is provided with a suitable recess 260 for the reception of the flange 246, as well as with a semi-cylindrical recess 242 corresponding to the recess 241.

The manner of assembly of the straight line backshell assembly is substantially the same as that described with respect to FIGS. 3–5, except that the cable 11 is first bent outwardly, sufficiently to allow the flanged sleeve 244 to be moved up close to the front housing part 222, providing access to the leading end of the shielding braid. The braid is then splayed about the wedge-shaped clamping ring (not shown in FIG. 9 but identical to that illustrated in FIG. 8). Thereafter, the sleeve 244 is retracted over the clamping ring and the additional clamping rings are moved into position. The sleeve is then positioned within the recess 241 and the cylindrical outer end portion of the housing part 222. Once this is done, the back housing part 223 is positioned and snapped into place on the front housing part 222, and then secured in assembled relation by a threaded coupling sleeve corresponding to the sleeve 113 in FIG. 8.

In any of its forms, the backshell housing structure of the invention has significant advantages over conventional prior art structures. Most significantly, perhaps, is the greatly facilitated assembly procedure, which enables the shielding braid to be splayed about the principal clamping ring while the latter is already positioned quite precisely where it should be in the final assembly, without undue distortion of the conductor wires between the clamped braid and the terminal connector device. This ability enables the cable, with the gripped shielding braid to be simply laid into the still-opened backshell housing. If and to the extent the forward conductor portions require manipulation, they are exposed and accessible to the assembling operator, so that any such manipulation can be accomplished with facility and without excessive strain on the cable or its conductors. The cable, the braid, and the individual conductors are thus far less likely to be damaged in the terminating process than with conventional connector assemblies.

A further rather significant advantage of the new structure is its superior shielding of the EMI/RFI radiation. In the prior art device, the internally threaded portion of the adaptor sleeve 17 (see FIG. 1) typically has to terminate at least slightly short of the lower end of the peripheral flange 46. As a result, there is at least a small straight line path for the escape of EMI/RFI radiation from the assembled backshell housing, above the adaptor sleeve 17 and below the ends of the flange 46. In the device of the present invention, by contrast, the internal flanged sleeve 44 completely bridges the area of this gap and thus provides superior shielding against escape of radiations from the connector area.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A terminal connector assembly for joining a connector plug or the like to a multi-conductor shielded cable having a shielding braid, which comprises (a) a first backshell housing member having a closed tubular configuration at its forward end portion and being joinable at said end with a connector plug or the like, (b) said first backshell housing member having a remote end portion of partial tubular configuration including an unthreaded portion joining a threaded portion at the remote end extremity, (c) a second backshell housing member complementary partial tubular configuration to the remote end portion of said first housing member adapted to interfit with said remote end portion of the first housing member to form a closed backshell housing assembly, (d) said second housing member having a threaded portion at its remote end extremity complementary to said first mentioned threaded portion and forming therewith a cylindrical threaded end of the assembled housing parts, (e) a tubular sleeve insertable laterally into the open side of said first backshell housing member and secured therein upon assembly of said second backshell housing member, (f) said sleeve having a central passage and having an internal shoulder defining an opening for the reception of said cable, (g) one or more clamping rings received over said cable and positioned within said sleeve for clamping engagement with the shielding braid of said cable, (h) a threaded collar receivable over the threaded remote end of the assembled housing parts for securing said parts in assembled relation, and (i) shoulder means limiting forward movement of said sleeve in the backshell housing, (j) at least one of said clamping rings having a remote end portion engageable by said threaded collar for urging said clamping rings into a compression relationship with said sleeve.

* * * * *